US006799500B1

(12) United States Patent
Kulikowski

(10) Patent No.: US 6,799,500 B1
(45) Date of Patent: Oct. 5, 2004

(54) AMMUNITION POUCH

(76) Inventor: Ernie Kulikowski, 21 Roseborough Rd., Lugoff, SC (US) 29078

( * ) Notice: Subject to any disclaimer, the term of this patent is extended or adjusted under 35 U.S.C. 154(b) by 0 days.

(21) Appl. No.: 10/409,755

(22) Filed: Apr. 9, 2003

(51) Int. Cl.[7] ..... F41A 9/61
(52) U.S. Cl. ..... 89/34; 89/33.01; 89/1.1
(58) Field of Search ..... 89/34, 33.01, 1.1

(56) References Cited

U.S. PATENT DOCUMENTS 4,389,918 A * 6/1983 Peck ..... 89/34
4,397,378 A * 8/1983 Lee ..... 190/119
4,939,979 A * 7/1990 Capawana ..... 89/34
5,009,319 A * 4/1991 Jantzen ..... 206/544
5,873,504 A * 2/1999 Farmer ..... 224/576
6,435,390 B1 * 8/2002 Abramowicz ..... 224/629
6,675,693 B1 * 1/2004 Heayn ..... 89/34

* cited by examiner

*Primary Examiner*—Jack Keith
*Assistant Examiner*—M. Thomson
(74) *Attorney, Agent, or Firm*—Michael A. Mann; Nexsen Pruet Adams Kleemier, LLC

(57) ABSTRACT

A soft magazine or pouch for belted machine gun ammunition is disclosed. The pouch has a metal or plastic top with flexible sides and bottom made of woven fabric. The sides have internal pockets that carry plastic panels for structural support. One side also has an external pocket that carries a link injector. The bottom is held to the sides by a circumferential zipper that wraps around a majority of the perimeter of the sides, leaving a fabric hinge. Then by unzipping the zipper, the bottom swings open to permit filling the pouch with ammunition.

18 Claims, 3 Drawing Sheets

AMMUNITION POUCH

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

The machine gun is a principal weapon in any modern arsenal. Like any other weapon, the employment and use of the machine gun is restrained by cost, time, and utility. Such restrains also apply to machine gun ammunition, which is needed in great quantities to support any military operation. Consequently, machine gun ammunition must be able to be deployed and handled rapidly at lowest cost.

Invariably the handling of machine gun ammunition presents several logistical concerns during field use, unprotected machine gun ammunition is subjected to exposure to water, dust, and debris, which can cause the gun to malfunction, presenting a major risk during combat. To minimize this risk, machine gun ammunition is put into ammunition boxes, and is often put on belts to function with the self-loading mechanism of most machine guns. The ammunition package or container must also be designed so that it does not interfere with other military objectives. For example, it must require little maintenance.

Flexibility is a significant prerequisite to achieving a successful military force. A modem military operation requires participants that can rapidly adapt to changed environmental conditions, reinforced opposing forces, altered objectives, and revised tactics. In response to such variables, a gunner must be able to change the amount of ammunition needed for a given objective. The gunner will have to subdivide ammunition into usable lengths and package it for transport, often at a moment's notice.

Logistical considerations for handling ammunition are not new. Over the years since the first machine guns were introduced, inventors have developed ways of holding conveniently-sized quantities of ammunition at the ready. Most inventors have simply chosen various forms of metal boxes sized according to the dimensions of the ammunition cartridges and equipped with lids for loading and handles for carrying. A typical example of this type of box is U.S. Pat. No. 2,401,762, issued to Irasek. However, these boxes, despite achieving basic utility at moderate cost, are obsolete. Metal boxes are heavy, rust-prone, and noisy when handled.

Recognizing the shortcomings of metal boxes, some inventors have tried designs using fabric or plastic. A flexible, fabric pouch for machine gun ammunition is currently in use. However, this pouch is difficult to refill with ammunition because it has a zippered slit on the bottom. It is difficult to fit a belt of ammunition through a slit. Therefore an improved ammunition pouch is needed that will be lighter and easier to use than prior art pouches.

SUMMARY OF THE INVENTION

Briefly recited and according to its major aspects, the present invention is a semi-rigid fabric pouch designed to hold belted ammunition for a machine gun such as the M-249 and Mark 48. The pouch is essentially rectangular in shape and has a top that mates with the machine gun. The top of the pouch is rigid and is attached to its flexible sides and a bottom, all of which are made of woven fabric. The sides have interior pockets that hold stiff panels to give structural reinforcement to the pouch. One of the sides has an external pocket designed to hold a link injector. The bottom is attached to the sides by a circumferential zipper and a fabric hinge, which, when the zipper is unzipped, allows the bottom to act as a lid to facilitate refilling the pouch, and when zipped, prevents dust and debris intrusion. There is also means for holding the zipper in the closed or zipped position.

A key advantage of the present invention is the use of reinforced fabric. The fabric and side-panel construction does not corrode, is light-weight, and maintains its shape even when the gun is supported by the pouch. The ability of the pouch to maintain its shape also facilitates rapid loading.

Another advantage of the present invention is the retention of the link ejector in the external pocket. Keeping the link ejector in the external pocket makes the link ejector handy for the user. Furthermore, the pocket is positioned to hold the ejector near the top opening where it can be attached to the first round of ammunition of the belt. The ammunition belt can thus be quickly fed into a gun using the link ejector, but also securely held during transport and storage.

Yet another advantage of the present invention is the circumferential zipper and fabric hinge for the bottom lid. The hinge and zipper allow a user to rapidly and easily refill the pouch with ammunition when opened, while keeping out dust and debris when closed Still another advantage of the present ammo pouch design is the sound-deadening aspect of the side construction. The use of two fabric panels with a plastic panel in between helps to muffle the sound of the ammunition in the pouch.

Other features and their advantages will be apparent to those skilled in the art of firearm accessory design and fabrication from a careful reading of the Detailed Description of Preferred Embodiments accompanied by the following drawings.

DETAILED DESCRIPTION OF PREFERRED EMBODIMENTS

The preferred embodiment of the present invention is a rectangular-shaped pouch or enclosure with a top made of rigid material, such as metal, composite, or molded plastic, and sides and a bottom made of flexible, woven fabric. The fabric is any commercially available military type that is wear and rot resistant, and preferably made of a ballistic material such as KEVLAR. The fabric pieces (sides) are attached by conventional methods used for fabricating bags and containers for military use, such as by sewing and/or gluing. The sides have interior pockets dimensioned to hold stiff plastic side panels. The side panels provide structural support for the pouch. In the preferred embodiment, the same type of fabric will be used to form the bottom and a hinge that joins the bottom to one of the sides. The fabric will also be used to form an exterior pocket on one side that is dimensioned to hold a link ejector.

Figure 1:
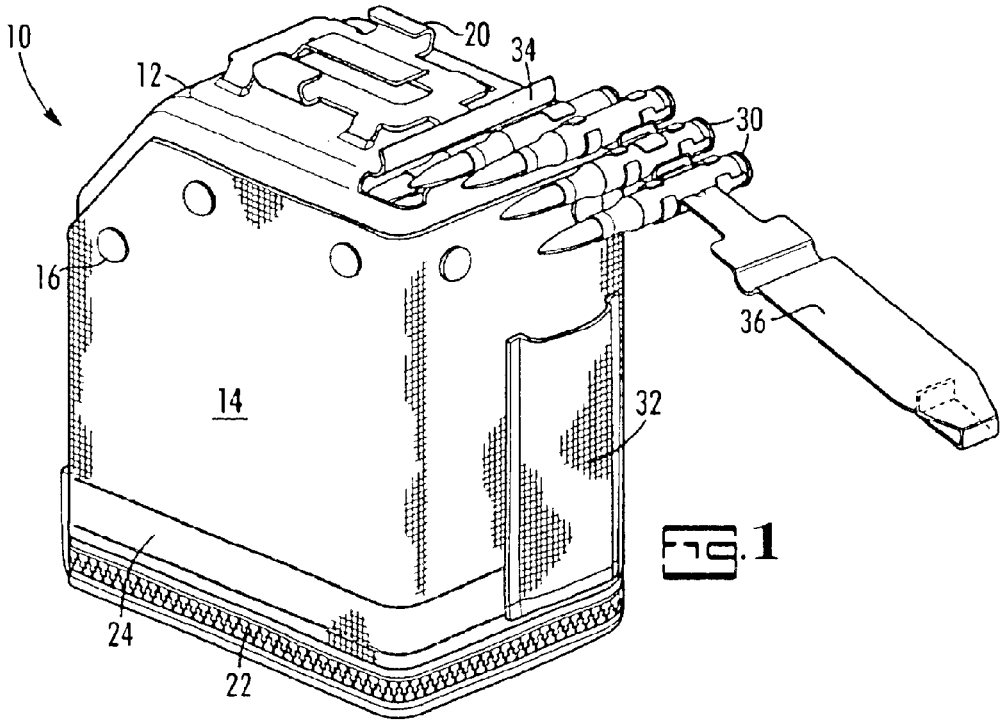
FIG. 1 is a perspective view showing the pouch as loaded with ammunition with the bottom closed.

Referring now to FIG. 1, there is shown a perspective view of the preferred embodiment of the present invention, an ammunition pouch generally indicated by reference number 10. A top 12 is formed to mate with sides 14, which are fastened to top 12 with rivets 16, thus forming the upper part of the enclosure. In the preferred embodiment, top 12 is made of metal, however other materials, such as composites or plastics, could be used. In such alternative embodiments, the manner in which top 12 is fastened to sides 14 can be adjusted to suit the most efficient process, e.g. sewing, heat staking, integral molding, etc. Top 12 also carries a receiver interface 20 that allows a user to mount pouch 10 to a machine gun (not shown). In the preferred embodiment, receiver interface 20 is a clip, although other retention systems are foreseeable if pouch 10 is adapted for other weapons other than the M-249 and Mark 48.

Running along the perimeter of the bottom edge of at least three of four sides 14 is a circumferential zipper 22. A reinforcement collar 24 provides a sewing edge to secure three of sides 14 to zipper 22. Reinforcement collar 24 also gives the bottom of pouch 10 a rectangular shape suitable to receive belted ammunition 30. In the preferred embodiment, zipper 22 and reinforcement collar 24 are made of plastic, however various other commonly available corrosion-resistant materials, such as brass, could also be used.

Still referring to FIG. 1, a link ejector pocket 32 is shown attached to one of sides 14. Link ejector pocket 32 is located so that enough ammunition 30 protrudes from an outlet 34 in top 12 to allow a link ejector 36 to be connected to ammunition 30 and firmly held in link ejector pocket 32, thus preventing ammunition 30 from flapping and working loose. In the preferred embodiment, link ejector pocket 32 is made from the same material as sides 14 and is sewn to side 14. Other embodiments may use other commercially available materials, such as plastic, and other fastening methods, such as gluing, for link ejector pocket 32. When the user loads the machine gun, link ejector 36 is removed from link ejector pocket 32 and placed into an open receiver. Once link ejector 36 is removed from link ejector pocket 32, belted ammunition 30 may be fed freely from outlet 34 by link ejector into the feed tray (not shown). Any link remaining in the tray will be pushed out by the ejector. Then link ejector can be pulled through the feed tray from the other side to position the next round for firing.

Figure 2:
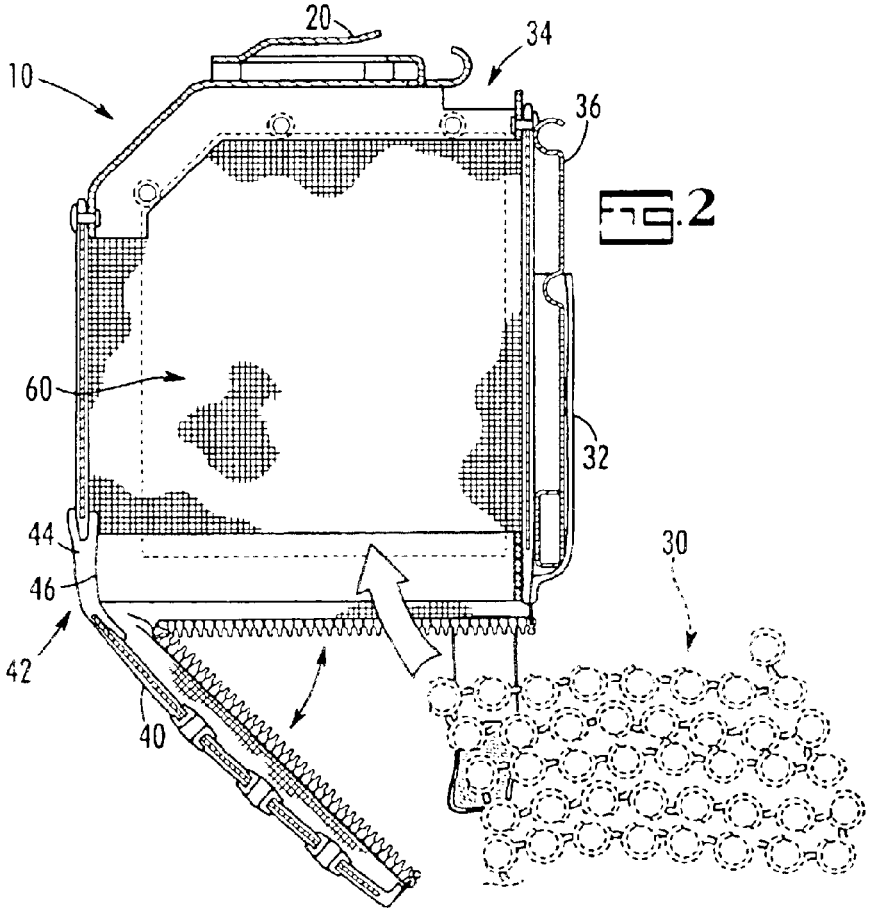
FIG. 2 is a cross-sectional view taken along lines 2—2 of FIG. 4 showing the loading of ammunition into the pouch with the bottom open.

Referring now to FIG. 2, there is shown a side view of pouch 10 with a bottom 40 in the open position. In the preferred embodiment, bottom 40 is retained to one of sides 14 by a fabric hinge 42 and is formed of the same woven fabric as sides 14. Hinge 42 consists of an extension flap 44, which is a piece of woven fabric integrated to bottom 40, and a reinforcing strip 46, which partially covers the resulting seam between bottom 40 and side 14. Extension flap 44 is sewn to the lower exterior of side 14, and reinforcing strip 46 is sewn to the innerside of bottom 40 and the inner side of side 14 (shown on FIG. 5).

In the preferred embodiment of the present invention, zipper 22 runs along the lower edge of three sides 14. However, another embodiment where zipper 22 runs along the edge of all sides 14 is possible. In the preferred embodiment, reinforcing strip 46 provides a positive stop for zipper 22. In the alternative embodiment where zipper 22 runs along the edge of all sides 14, reinforcing strip 46 covers the portion of zipper 22 that runs along the edge of side 14 corresponding to hinge 42. In the alternative embodiment, reinforcing strip 46 also provides a positive stop for zipper 22. In both embodiments, bottom 40 is moved to the open position by unzipping circumferential zipper 22 to a stop and then rotating bottom 40 about hinge 42. With bottom 40 in the open position, ammunition 30 may be conveniently placed into pouch 10.

Figure 4:
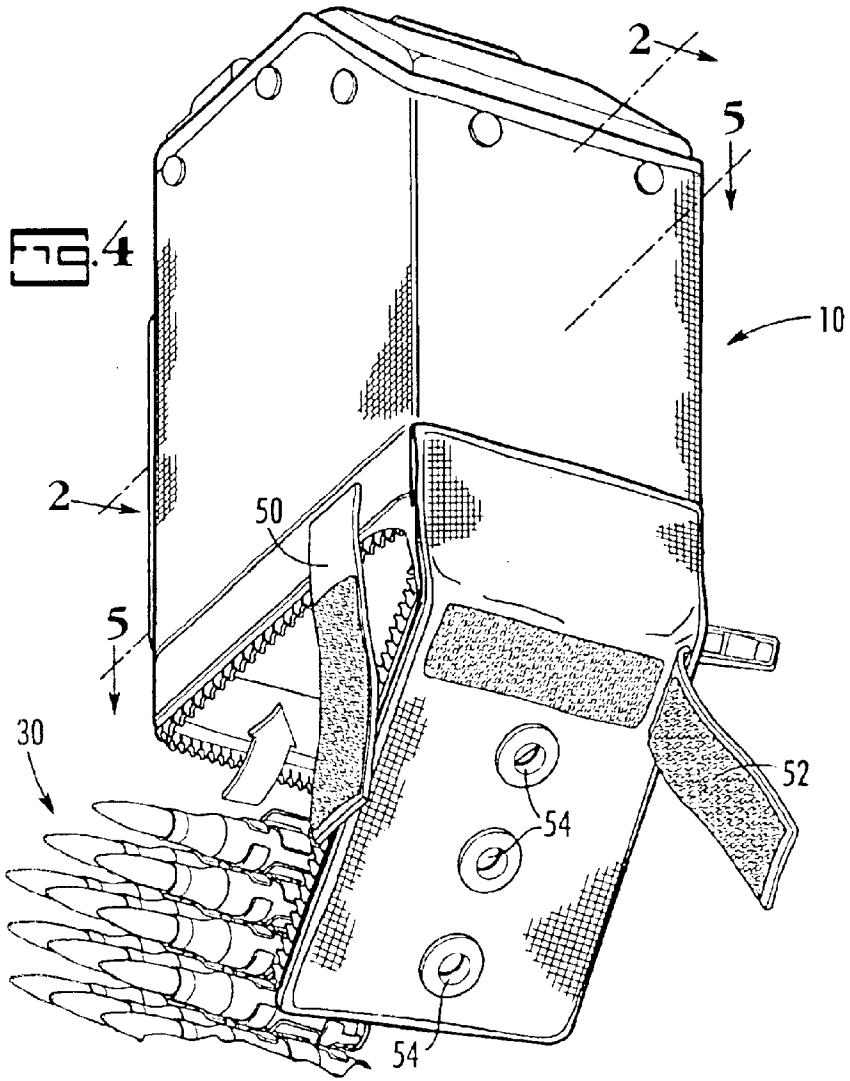
FIG. 4 is a bottom perspective view showing the bottom open.
Figure 3:
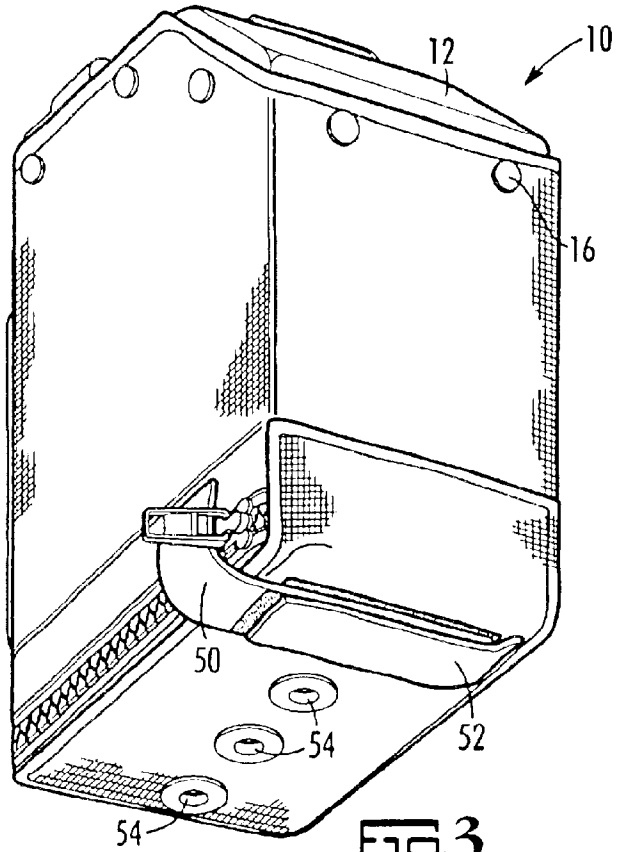
FIG. 3 is a bottom perspective view showing the bottom closed.

Referring now to FIG. 3, there is shown a bottom view of pouch 10 with bottom 40 in the closed position, i.e. with zipper 22 is fully zipped. Hinge 42 is also shown in FIG. 4, with bottom 40 shown in the open position. When zipper 22 is fully zipped, a zipper retention means may be employed to hold zipper 22 in the fully zipped position. In the preferred embodiment, the zipper retention means consists of a zipper retainer strap 50, which is sewn to one of sides 14, and a retainer strap anchor 52, which is sewn to bottom 40. A hook and loop retention system is to be used on both strap 50 and anchor 52, although other retention systems, such as buttons, may be used in other embodiments. Drain holes 54 are also integrated in bottom 40 to allow water to drain from pouch 10.

Figure 5:
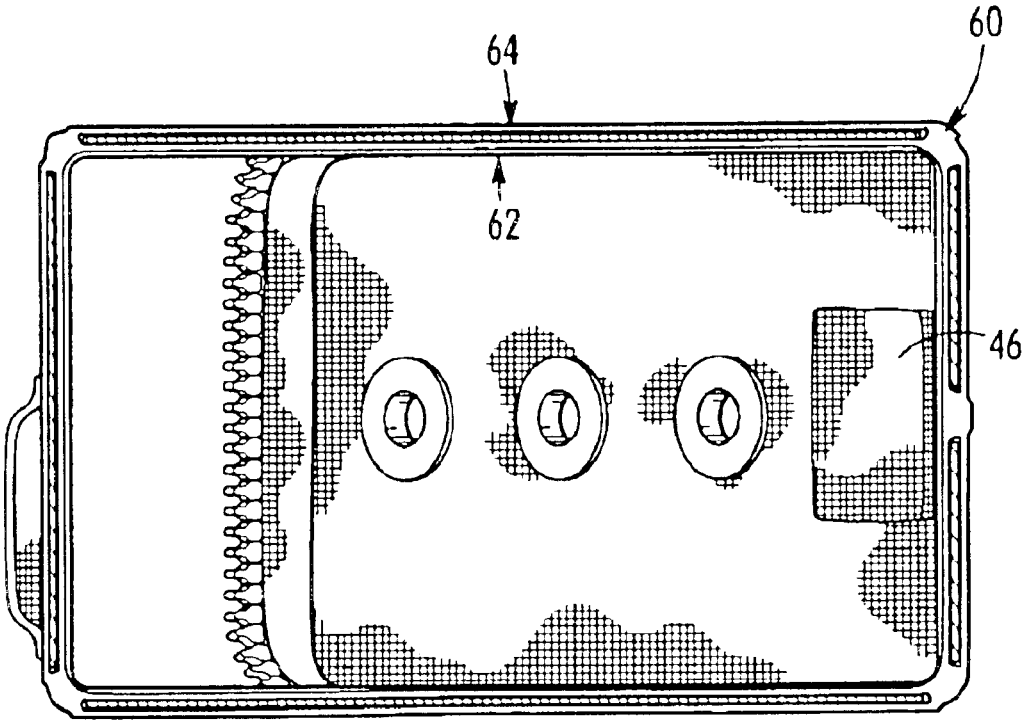
FIG. 5 is a bottom cross-sectional view taken along lines 5—5 of FIG. 1.

Referring to FIG. 2 and FIG. 5, stiff side panels 60 are shown in sides 14. In the preferred embodiment, side panels 60 are made of plastic. The plastic is flexible enough to bend without shattering due to impacts, is thin enough to keep weight and bulk to a minimum, and is strong enough to provide support for the gun. Since sides 14 are made of a woven fabric, they are not capable of providing structural support when loaded in compression, especially when pouch 10 is not full. Side panels 60 provide structural support for pouch 10 when loaded in compression to facilitate loading and storage. Sides 14 have two layers of woven fabric: an inner layer 62 and an outer layer 64. Inner layer 62 is sewn to outer layer 64 creating a gap in between. The gap and sewn edges of the layers define pockets that are dimensioned so that side panels 60 will be retained once inserted in the pockets.

It will be readily apparent to those skilled in the art of firearm accessory design and fabrication that many changes and substitutions can be made to the foregoing preferred embodiments without departing from the spirit and scope of the present invention, defined by the appended claims.

What is claimed is:

1. A pouch for holding belted machine gun ammunition, said pouch comprising:

(a) a top, said top having an outlet and a machine gun receiver interface;

(b) sides attached to said top;

(c) a bottom attached to said sides, said top, bottom, and sides of said pouch defining an enclosure dimensioned for receiving belted ammunition; and (d) a zipper carried by said sides and attaching said sides to said bottom, said zipper allowing said bottom to move hingedly between an open position and a closed position, said zipper permitting filling said enclosure, when said bottom is in said open position, with said belted ammunition, said belted ammunition then extending from said top of said pouch through said outlet.

2. The pouch as recited in claim 1, wherein said sides further comprise:

(a) an outer layer made of woven fabric;

(b) an inner layer made of woven fabric sewn to said outer layer thus defining a pocket between said outer and inner layers; and (c) a panel carried in said pocket.

3. The pouch as recited in claim 1, wherein said bottom is made of woven fabric.

4. The pouch as recited in claim 1, wherein said top is formed from a material selected from the group consisting of metals, plastics, and composites.

5. The pouch as recited in claim 2, wherein said panel is made of plastic.

6. A pouch for holding belted machine gun ammunition, said pouch comprising:

(a) a top having an outlet;

(b) a machine gun receiver interface carried by said top;

(c) sides attached to said top;

(d) a bottom attached to said sides, said top, bottom and sides defining an enclosure;

(e) means formed in said sides for facilitating insertion of a belt of ammunition into said enclosure, said belt extending from said top of said pouch through said outlet; and (f) an external pocket attached to said sides, said external pocket dimensioned for receiving a link ejector.

7. The pouch as recited in claim 6, wherein said bottom has at least one drain hole.

8. The pouch as recited in claim 6, wherein said facilitating means is a zipper.

9. The pouch as recited in claim 6, wherein said top has an outlet formed therein, and wherein, when a belt of ammunition is in said pouch, said external pocket is positioned in spaced relation to said outlet so that said link ejector can reside in said pocket and be connected to a first round of said belt of ammunition.

10. A pouch for holding belted machine gun ammunition, said pouch comprising:

(a) a top having an outlet insert;

(b) sides attached to said top;

(c) a bottom spaced apart from and opposing said top said top, sides and bottom defining an enclosure;

(d) a zipper carried on said sides and connecting said bottom to said sides so that said pouch is closed when said zipper is zipped and said pouch is open with said zipper is unzipped, said enclosure dimensioned to receive ammunition when said pouch is open and, when ammunition is received within said enclosure, said ammunition is fed from said top of said pouch through said outlet; and (e) means for retaining said zipper when said zipper is fully zipped.

11. The pouch as recited in claim 10, wherein said zipper is made from a corrosion-resistant material.

12. The pouch as recited in claim 10, wherein said zipper retention means comprises:

(a) a fabric flap; and (b) a hook and loop fastener.

13. A pouch for holding belted machine gun ammunition, said pouch comprising:

(a) a top having an outlet and adapted to be attached to a machine gun so that ammunition carried within said pouch can be fed directly to said machine gun through said outlet;

(b) sides attached to said top;

(c) a machine gun receiver interface carried by said ton:

(d) a bottom spaced apart from and opposing said top attached to said sides, said top, sides and bottom defining an enclosure; and (e) means carried by said sides for opening said pouch, said opening means adapted to allow a major portion of said bottom to swing away from said sides, thus leaving a minor portion to serve as a hinge and defining thereby an opening dimensioned for receiving said ammunition into said enclosure.

14. The pouch as recited in claim 13, wherein said sides are made of a fabric.

15. pouch as recited in claim 13, wherein said sides are made of two layers and further comprising plural panels located between said layers to provide stiffening of said sides.

16. The pouch as recited in claim 13, wherein said opening means is a zipper.

17. The pouch as recited in claim 13, further comprising a pocket carried by said sides.

18. The pouch as recited in claim 17, wherein said pocket is dimensioned to hold a link ejector.

* * * * *

UNITED STATES PATENT AND TRADEMARK OFFICE

CERTIFICATE OF CORRECTION

PATENT NO. : 6,799,500 B1
APPLICATION NO. : 10/409755
DATED : October 5, 2004
INVENTOR(S) : Ernie Kulikowski It is certified that error appears in the above-identified patent and that said Letters Patent is hereby corrected as shown below:

Title Pg. Insert:
-- (73) Assignee: FN Manufacturing, LLC Columbia, SC --.

Signed and Sealed this

Twentieth Day of January, 2009

JON W. DUDAS
*Director of the United States Patent and Trademark Office*